United States Patent [19]

Parmley

[11] B 3,994,693

[45] Nov. 30, 1976

[54] EXPANDABLE METAL MEMBRANE

[75] Inventor: Richard T. Parmley, Cupertino, Calif.

[73] Assignee: Lockheed Missiles & Space Company, Inc., Sunnyvale, Calif.

[22] Filed: Dec. 5, 1973

[21] Appl. No.: 421,975

[44] Published under the second Trial Voluntary Protest Program on March 2, 1976 as document No. B 421,975.

[52] U.S. Cl. ..... 29/180 SS; 29/183; 52/573; 220/9 LG; 220/63 R

[51] Int. Cl.[2] ..... B22F 5/00

[58] Field of Search ..... 29/180 SS, 183; 220/9 LG, 63, 9 G; 165/81; 161/65, 99; 52/573, 560, 276

[56] References Cited

UNITED STATES PATENTS

| | | | |
|---|---|---|---|
| 2,158,929 | 5/1939 | Dunajeff | 29/180 SS |
| 3,150,793 | 9/1964 | Messer | 220/9 R |
| 3,215,301 | 11/1965 | Armstrong | 220/9 LG |
| 3,485,596 | 12/1969 | Alleaume | 29/183 |
| 3,510,278 | 5/1970 | Alleaume | 29/183 |
| 3,517,850 | 6/1970 | Saldern et al. | 220/9 R |
| 3,800,970 | 4/1974 | Jackson | 220/9 LG |
| 3,802,853 | 4/1974 | O'Connor | 29/183 |
| 3,824,664 | 7/1974 | Seeff | 29/180 SS |

*Primary Examiner*—Walter R. Satterfield
*Attorney, Agent, or Firm*—H. Donald Volk; Billy G. Corber

[57] ABSTRACT

An expandable metal membrane of the type used to contain cryogenic liquids is disclosed. The membrane utilizes two sets of triangular shaped corrugations at right angles to each other. The corrugations are arranged so that the membrane expands only along one axis at each intersection of the corrugations and the expansion of the membrane along two axes simultaneously is assisted by the rotation of the panel enclosed by each two sets of corrugations.

6 Claims, 4 Drawing Figures

FIG. 1
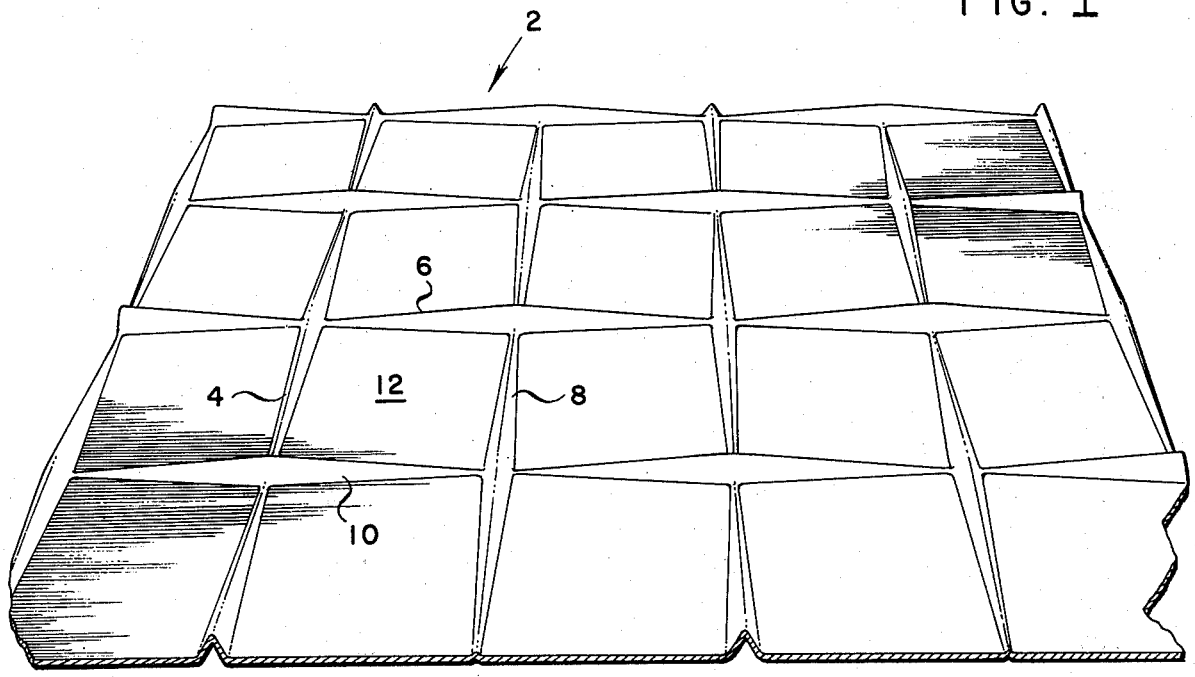
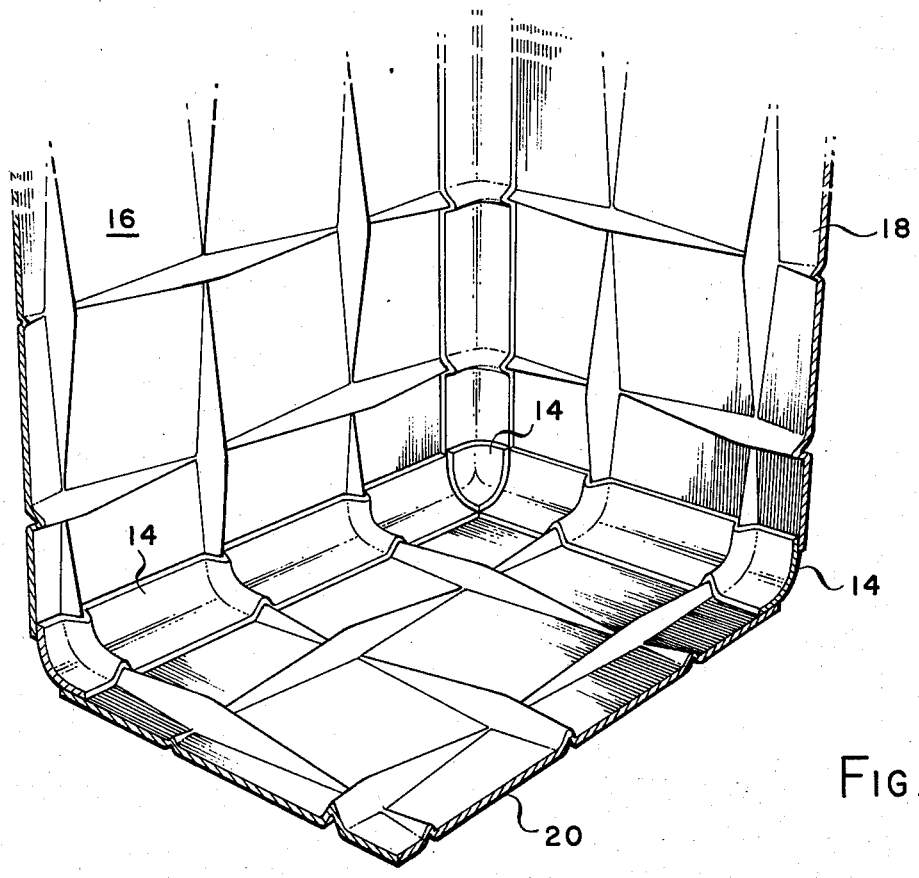
FIG. 4

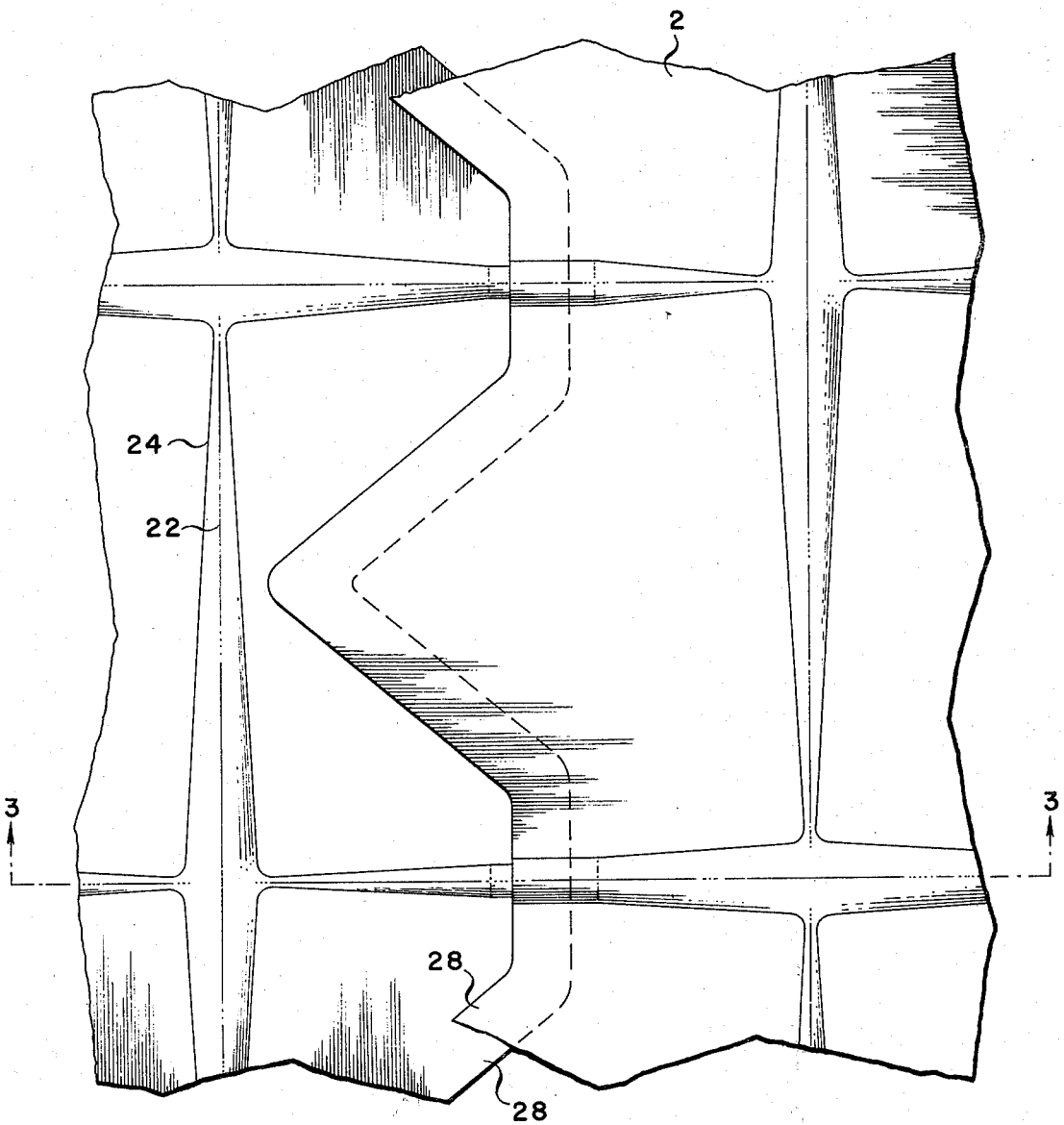
FIG. 2
FIG. 3
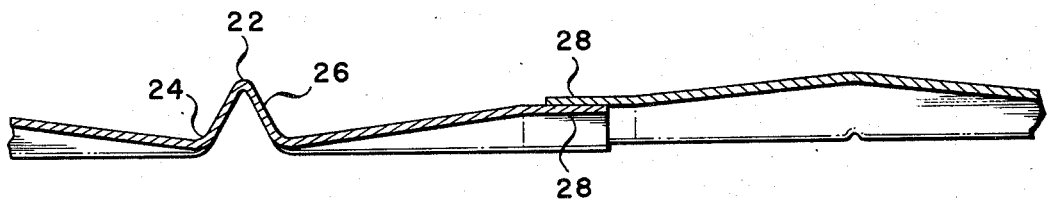

EXPANDABLE METAL MEMBRANE

BACKGROUND OF THE INVENTION

This invention relates to membrane tanks containing cryogenic liquids.

In the storage of very cold liquids in large containers, difficulties arise where stresses are set up in the metal membrane which exceed the elastic limit of the metal. This can cause permanent deformation of the metal membrane and possibly rupture of the metal membrane itself.

To avoid the severe stresses, it is possible to use metal membranes containing corrugations, dimples or wrinkles. One such technique is disclosed in U.S. Pat. No. 3,150,795 entitled "Membrane Tanks". While the membrane tank described in that patent has been found to be a significant advance in the state of the art, it has certain limitations because the dimples allow limited expansion along one axis while restricting expansion along the other axis.

Another technique is disclosed in U.S. Pat. No. 3,184,094 entitled "Extensible Metal Sheets". While this expandable membrane has been found to be a significant advance in the state of the art since it can expand along two axes, it still has certain limitations which are overcome by the present invention. Specifically, due to its complex shape it is hard to manufacture and is susceptible to rupture or permanent deformation where the corrugations intercept.

Other arrangements of corrugations have been proposed. Examples are described in U.S. Pat. Nos. 3,224,621; 3,302,358; 3,215,301; 3,332,386 and 3,547,302. These systems are hard to manufacture because of their complex shape, because metal must expand along two axes where the corrugations meet. Moreover, these systems are susceptible to rupture or permanent deformation where the corrugations intercept.

In contrast, the expandable membrane system of the invention provides that the membrane has to expand only in one axis at the junction of two expansion joints and in expansion joints at right angle to each other. It also provides that adjacent panels assist in the expansion and contraction by rotating in opposite directions.

BRIEF DESCRIPTION OF THE DRAWING

Further objects, features and advantages of the invention pertain to the particular arrangement and structure whereby the above mentioned aspects of the invention are attained. The invention will be better understood by reference to the following description and to the drawings forming a part thereof, wherein:

FIG. 1 is a perspective view of the extensible metal sheet;

FIG. 2 shows a partial top view of a part of two expandable sheets and the method of joining the sheets together;

FIG. 3 is a partial cross section of FIG. 2 taken through the line 3-3; and FIG. 4 is a perspective view of the completed corner between the walls and the floor of a membrane.

DESCRIPTION OF THE PREFERRED EMBODIMENT

Referring first to FIG. 1, there is shown therein an exemplary expandable metal membrane 2 in accordance with the present invention. Four adjacent corrugations, 4, 6, 8 and 10 form two sets of mutually perpendicular corrugations. The corrugations have a triangular shape and are so arranged so that the maximum height of one corrugation intersects the substantially flat end of the corrugation meeting it at right angles. The bottoms of the adjacent ends of the four corrugations enclose a flat area 12 whose plane lies in the plane of extensible sheet 2.

The corrugations can be viewed as either a series of tapered wedges or a plurality or sets of chains of elongated pyramidal corrugations. The tapered wedges or elongated pyramidal corrugations define an apex at the highest point, and distal corners where the cusp 22 intersects the valley 24.

Extensible sheet 2 can be fabricated by stamping, rolling or hydroforming a suitable section of stainless steel, aluminum alloy or other materials such as Invar, manufactured by Carpenter Technology.

FIG. 2 and FIG. 3 show how larger panels can be fabricated by arranging extensible sheets in side by side and end to end relationship with the edges overlapping one another by a slight amount to bring the corrugations of one sheet into nesting relationship of the corrugation of the other panels adjacent thereto. The overlapping edges 28 of the panels can then be joined by suitable joining means, such as adhesive, welding or brazing to effect a sealing relationship between the panels. In this way a continuous impermeable membrane can be formed.

Again referring to FIG. 2, each corrugation includes a cusp 22 which linearly varies from the height of the flat area on one end to a maximum height or axes at its other extreme. Along with valley 24, it forms a pair of angled tapered flanks 26.

FIG. 4 shows how a corner can be formed. Pan-shaped sections 14 are welded or otherwise sealably attached to the ends of adjacent wall portions. Pan-shaped sections 14 include corrugations corresponding to the corrugations on the three mutually perpendicular walls 16, 18 and 20. To complete the corner, preshaped section 14 is welded to the ends of the other preshaped sections 14 to form a impermeable container.

When extensible sheet 2 is thermally contracted or extended, corrugations 4, 6, 8 and 10 open and close, thus exerting bending moments on the edges of flat area 12. This causes flat area 12 to rotate; thereby assisting the corrugations in contracting or extending extensible sheet 2 along its two axes.

It may be seen that there has been described herein an improved expandable metal membrane having numerous advantages in both its structure and operation. The structure described herein is presently considered to be preferred; however, it is contemplated that further variations and modifications within the purview of those skilled in the art can be made herein. The following claims are intended to cover all such variations and modifications as fall within the true spirit and scope of the invention.

What is claimed is:

1. An expandable metal membrane for use under conditions of large temperature changes comprising:

a first set of simple tapered expansion wedges defining a first set of substantially parallel spaced corrugations, each of said tapered wedges in said first set defined as terminating in an apex at one end and tapering to a point at the other end, a second set of simple tapered expansion wedges defining a second set of substantially parallel spaced corrugations, each of said tapered wedges in said second set defined as terminating in an apex at one end and tapering to a point at the other end, said second set of corrugations being mutually perpendicular with said first set of corrugations and defining a plurality of flat enclosed areas.

2. The expandable metal membrane of claim 1 wherein the point of each of said tapered wedges in said first set contacts the adjacent mutually perpendicular tapered wedge in said second set proximate the apex of said adjacent mutually perpendicular tapered wedge, and wherein the point of each of said tapered wedges in said second set contacts the adjacent mutually perpendicular tapered wedge in said first set proximate the apex of said adjacent mutually perpendicular tapered wedge.

3. The expandable metal membrane of claim 2 wherein said enclosed area is a square.

4. An expandable metal sheet comprising:

a first set of substantially parallel transversely spaced chains of first elongated pyramidal corrugations, a second set of substantially parallel transversely spaced chains of second elongated pyramidal corrugations, said first set and said second set of elongated pyramidal corrugations intersecting each other at substantially right angles so as to define a network of uniform pattern consisting of smooth, uncorrugated, regular quadrilateral areas.

5. The expandable metal sheet of claim 4 wherein each of said first and second elongated pyramidal corrugations are further defined as including an apex, a pair of distal corners, and a valley connecting said distal corners, the said distal corners of each of said first and second elongated pyramidal corrugations bisecting the said valley of the intersecting elongated pyramidal corrugations to define the four corners of each of said quadrilateral areas, thereby allowing said sheet to expand and contract in response to temperature change by the angular rotary movement of said enclosed area due to the flexing of said elongated pyramidal corrugations.

6. The expandable metal sheet of claim 5 wherein said quadrilateral area is an equilateral quadrilateral.

* * * * *